US005688009A

United States Patent [19]

Pienta

[11] Patent Number: 5,688,009

[45] Date of Patent: Nov. 18, 1997

[54] C-HOOK PUSHER ASSEMBLY

[75] Inventor: David J. Pienta, Lambertville, Mich.

[73] Assignee: Automatic Handling, Inc., Erie, Mich.

[21] Appl. No.: 617,320

[22] Filed: Mar. 18, 1996

[51] Int. Cl.[6] ..... B66C 1/22

[52] U.S. Cl. ..... 294/67.2; 414/911

[58] Field of Search ..... 294/67.2, 67.21, 294/67.22, 67.5, 86.41, 103.2; 414/280, 626, 659, 661, 684, 908, 910, 911

[56] References Cited

U.S. PATENT DOCUMENTS

| | | | |
|---|---|---|---|
| 1,546,364 | 7/1925 | Bennington | 294/67.2 X |
| 1,896,543 | 2/1933 | Gfrorer | 414/661 X |
| 2,495,658 | 1/1950 | Moseley | 294/67.21 |
| 2,913,276 | 11/1959 | Collings | 294/86.41 X |
| 3,258,287 | 6/1966 | Crosby | 294/67.21 |
| 3,517,959 | 6/1970 | Ferguson | 294/67.22 |
| 4,789,295 | 12/1988 | Boucher et al. | 294/67.22 X |
| 4,878,798 | 11/1989 | Johansson | 414/661 X |

FOREIGN PATENT DOCUMENTS

| | | | |
|---|---|---|---|
| 1816652 | 6/1979 | Germany | 294/67.21 |
| 550332 | 3/1977 | U.S.S.R. | 294/67.2 |

*Primary Examiner*—Johnny D. Cherry
*Attorney, Agent, or Firm*—Emch, Schaffer, Schaub & Porcello Co., L.P.A.

[57] ABSTRACT

A C-hook pusher assembly for use with a material handling lift is disclosed. A frame member is connected to the lift. A longitudinally extending probe is positioned parallel to the frame. An end joins the frame and the probe. A motor driven screw is journaled by the frame. A drive block is threadably mounted on the screw. The drive block supports and drives a pusher arm. The pusher arm includes a pusher member which moves along the probe to reposition rolls which are carried by the probe.

5 Claims, 3 Drawing Sheets

14

11
10
3
15
15
3
24
25
27
21
20
13
28
39
29
12
35
37
37
37

C-HOOK PUSHER ASSEMBLY

BACKGROUND OF THE INVENTION

The present invention is directed to a C-hook pusher assembly. C-hook assemblies are known in the material handling art. C-hooks are generally used to pick-up items which have an opening. One such item is a roll. C-hook assemblies can be Utilized to pick-up many different kinds of rolls, for example metal rolls and paper rolls. They can also be used in picking up rolls having various widths and diameters.

One such prior art C-hook assembly is an Automatic Handling/Bucon Levomat Unit, which is shown and described in our copending U.S. patent application Ser. No. 08/541,403, filed Oct. 10, 1995.

The primary object of the present invention is to provide an improved C-hook assembly for use in material handling and particularly a C-hook assembly which includes a pusher arm for moving items, such as paper rolls for a predetermined distance along the probe member.

SUMMARY OF THE INVENTION

The present invention is a C-hook pusher assembly for use with a material handling lift. The improved C-hook pusher assembly includes a longitudinally extending frame member which is attached to a moveable arm of the material handling lift. A longitudinally extending probe is positioned below and parallel to the frame member. An end frame member is positioned between the upper frame member and the probe. A pusher arm is mounted for movement along the probe to urge items being carried by the probe to new predetermined positions.

DETAILED DESCRIPTION OF THE PREFERRED EMBODIMENT

Figure 1:
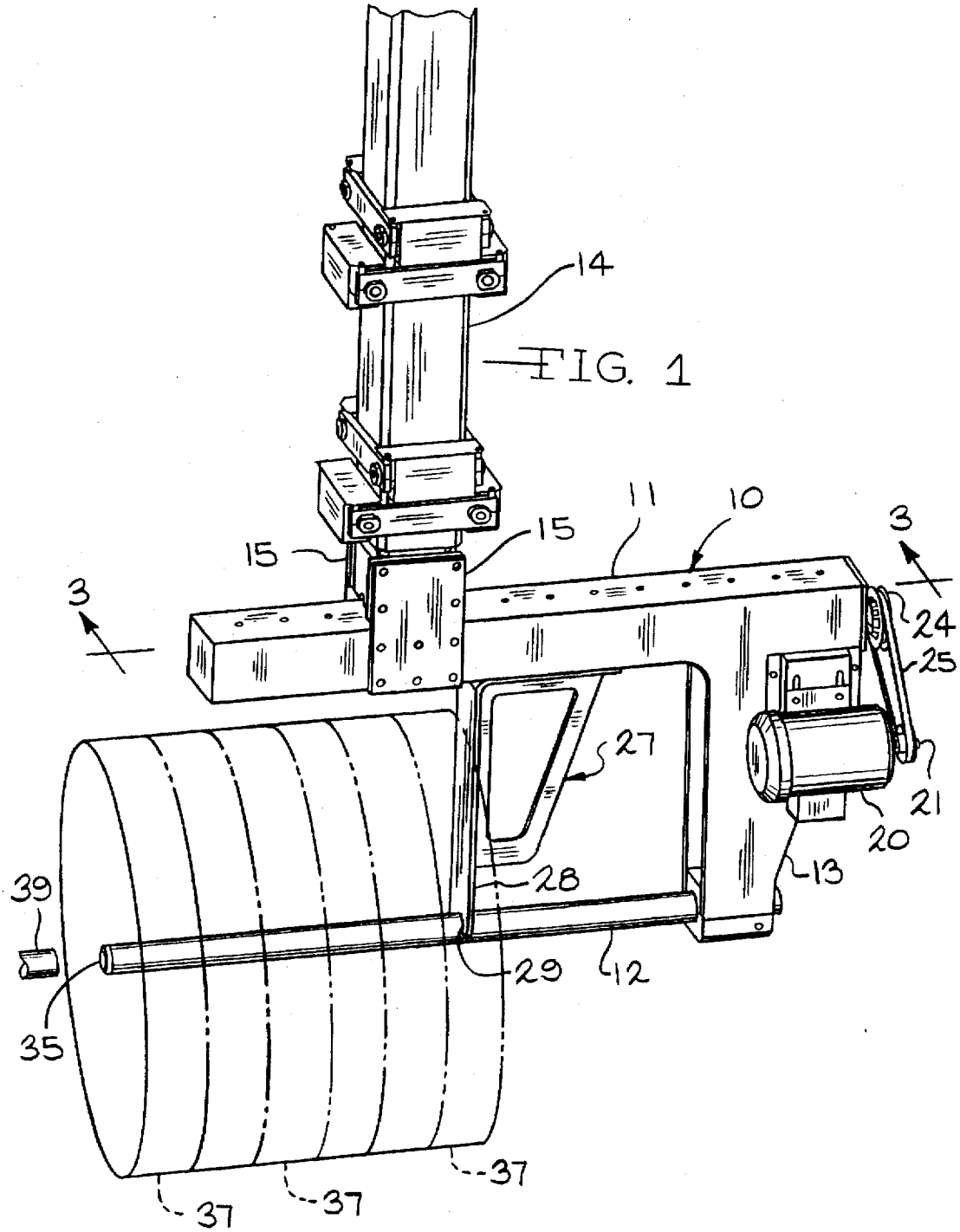
FIG. 1 is a perspective view of a C-hook pusher assembly, according to the present invention.
Figure 2:
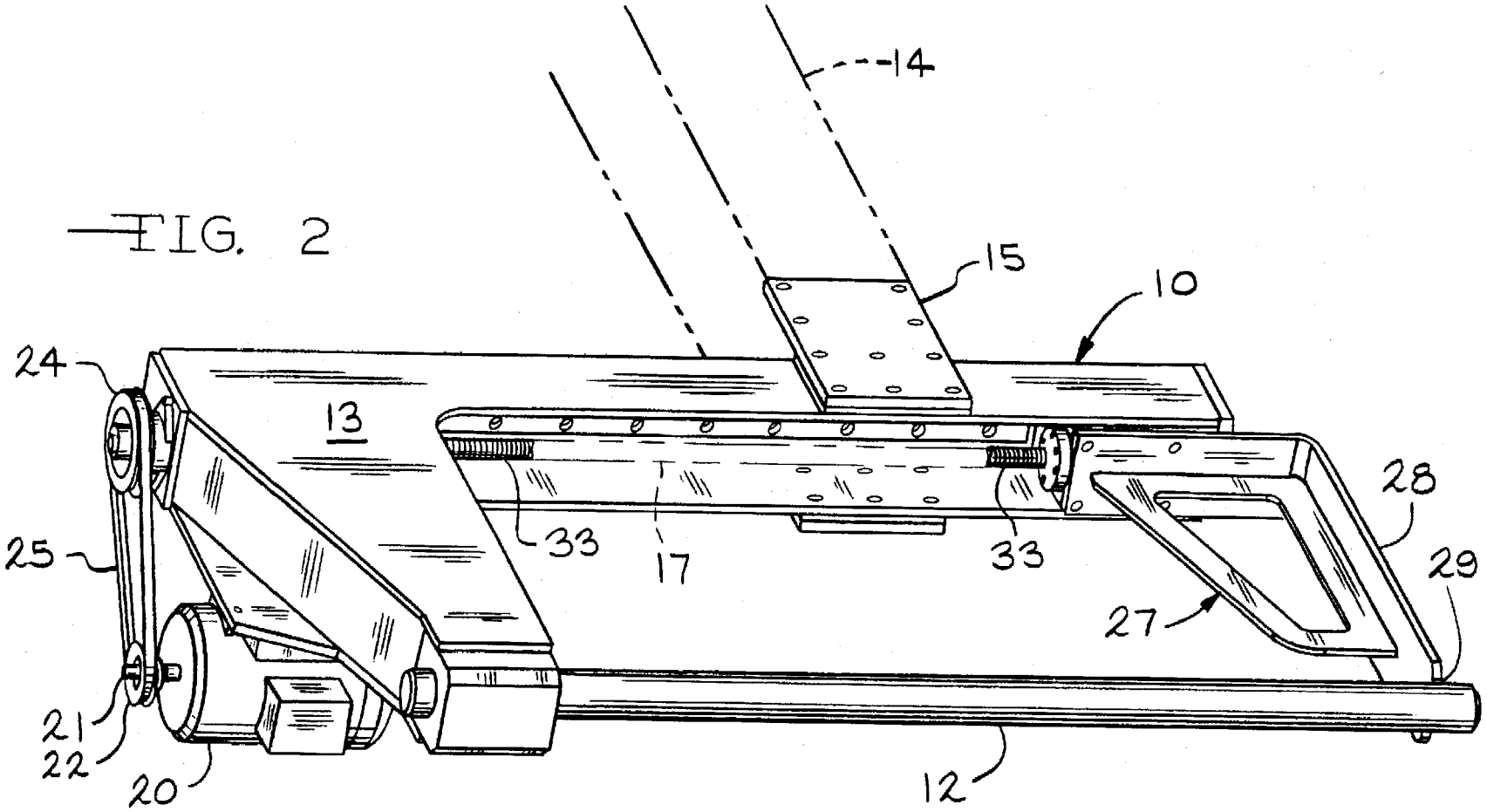
FIG. 2 is a perspective view, shown on an enlarged scale, of the C-hook pusher assembly shown in FIG. 1, with the pusher arm moved to another position.

A C-hook pusher assembly, according to the present invention, is generally indicated in the drawings by the reference number 10. The C-hook pusher assembly 10 includes a longitudinally extending frame member 11. A probe 12, which in this embodiment is a cylindrical rod, is positioned below and parallel to the frame member 11. The frame member 11 and probe 12 are joined together by an end or end assembly 13. A material lift, which is not a part of the present invention, includes a moveable arm 14. In the present embodiment, the moveable arm 14 is connected to the frame member 11 by a pair of mounting plates 15.

A longitudinally extending screw 17 is journaled by bearings 18 within the frame member 11. A motor 20 is mounted on the end 13 and includes an output shaft 21 which mounts a pulley 22. A pulley 24 is operatively connected to the screw 17. A drive belt 25 extends between the pulleys 22 and 24. Operation of the motor 20 drives or rotates the screw 17. In the present embodiment, the screw 17 is a modified Acme screw.

The C-hook pusher assembly 10 also includes a pusher arm 27. The pusher arm 27 has a pusher plate 28. A lower end 29 of the pusher plate 28 is complementary with the circumference of the cylindrical probe 12.

Figure 3:
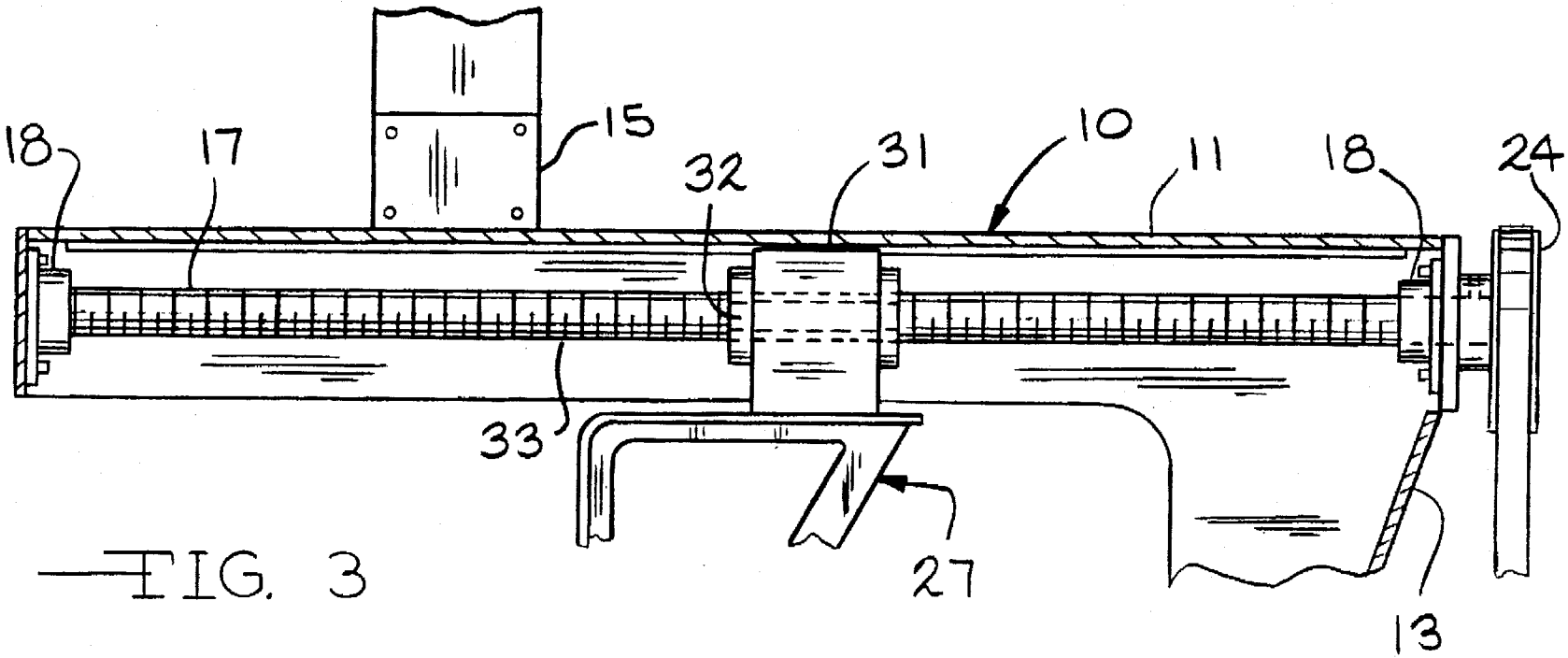
FIG. 3 is a sectional view taken along the line 3—3 of FIG. 1.

Referring to FIG. 3, the pusher arm 27 depends from a pusher block 31 which in turn is carried by the screw 17. The pusher block 31 defines a threaded opening 32 which mates with threads 33 defined by the screw 17.

In operation, the moveable arm 14 of the power lift material handling apparatus is positioned where, for example, the free end 35 of the probe 12 receives the center openings of a plurality of paper rolls 37. The plurality of paper rolls 37 are aligned along the probe 12. When in the initial position, the pusher arm 27 is generally moved to its rearward position, adjacent the frame end 13. This is accomplished by energizing the motor 20 and rotating the screw 17. The threaded engagement with the screw 17 moves the pusher block 31 and the attached pusher arm 27 to the desired position.

The arm 14 can then be moved to another position. At that time, all of the rolls 37 may be moved from the probe 12 by moving the pusher arm 27 to the left, as shown in FIG. 1.

In other situations, it is sometimes desired to only remove one or two of the rolls 37 to another probe or spindle 39 (See FIG. 1 ). In that method of operation, the arm 14 is moved until the free end 35 of the probe 12 and the spindle 39 are closely adjacent. The motor 20 is energized and the pusher block 31 moved a predetermined distance. Accordingly, this moves the pusher plate 28, the same predetermined distance to place the desired number of paper rolls 37 upon the spindle 39. The probe 12 and the spindle 39 are then separated and another operation can be performed.

Many revisions may be made to the above-described preferred embodiment without departing from the scope of the present invention or from the following claims.

I claim:

1. A C-hook pusher assembly for use with a material handling lift having a movable arm, comprising an upper frame member, a probe mounted parallel to said frame member, an end portion connected between said frame member and said probe, a rotatable screw mounted by said frame member, a motor for driving said screw, a pusher block mounted for movement along said screw and a pusher arm operatively mounted by said pusher block.

2. A C-hook pusher assembly according to claim 1, wherein said pusher arm includes a pusher plate for engaging rolls positioned on said probe.

3. A C-hook pusher assembly for use with a material handling lift having a moveable arm, comprising a longitudinally extending frame member for attachment to such moveable arm, a longitudinally extending probe positioned below and parallel to said frame member, an end frame member positioned between said longitudinal frame member and said probe, a pusher arm mounted for movement along said probe, a drive assembly operatively connected to said pusher arm for moving said pusher arm along said probe, said drive assembly including a screw journaled for rotation by said longitudinal frame member and a drive motor operatively connected to said screw for rotating said screw.

4. A C-hook pusher assembly, according to claim 3, including a pusher block mounted on said pusher arm, said pusher block having a threaded opening receiving said screw, whereby rotation of said screw moves said pusher block and said pusher arm.

5. A C-hook pusher assembly for use with a material handling lift having a moveable arm, comprising a longitudinally extending frame member for attachment to such moveable arm, a longitudinally extending probe positioned below and parallel to said frame member, an end frame member positioned between said longitudinal frame member and said probe, a pusher arm mounted for movement along said probe, a drive assembly operatively connected to said pusher arm for moving said pusher arm along said probe, said drive assembly including a longitudinally extending drive unit mounted by longitudinal frame member and a drive motor operatively connected to said drive unit for moving said drive unit and said pusher arm.

* * * * *